United States Patent [19]

Seiderman

[11] 4,155,127

[45] * May 22, 1979

[54] CUSHIONED TOILET SEAT ASSEMBLY

[76] Inventor: Abe Seiderman, 7365 SW. 132 St., Miami, Fla. 33183

[ * ] Notice: The portion of the term of this patent subsequent to Apr. 25, 1995, has been disclaimed.

[21] Appl. No.: 869,442

[22] Filed: Jan. 16, 1978

[51] Int. Cl.[2] ..... A47K 13/02; A47C 7/20

[52] U.S. Cl. ..... 4/234; 4/237; 5/404; 5/409; 29/432; 29/453; 297/455

[58] Field of Search ..... 4/234, 237, DIG. 8, 4/134; 297/452, 455, DIG. 1, 456, 457; 5/345, 353.1; 29/432, 453; D23/71

[56] References Cited

U.S. PATENT DOCUMENTS

| | | | |
|---|---|---|---|
| 582,247 | 5/1897 | Weston | 4/237 |
| 2,138,440 | 11/1938 | Boardman | 297/452 |
| 2,447,738 | 8/1948 | Conner | 4/234 X |
| 3,082,038 | 3/1963 | Sanderson | 297/452 X |
| 3,861,747 | 1/1975 | Diamond | 297/455 X |
| 3,863,277 | 2/1975 | Harrison | 4/234 X |
| 4,085,468 | 4/1978 | Seiderman | 4/237 |

*Primary Examiner*—Stuart S. Levy
*Attorney, Agent, or Firm*—Ernest H. Schmidt

[57] ABSTRACT

A cushioned toilet seat assembly wherein the seat and cover members are each fabricated with a pair of upper and lower base members upholstered about the respective tops and bottoms thereof, and wherein the covering material overlaps and is affixed to relative marginal portions of the respective base members in such a manner as to minimize abutting interference upon final assembly interconnection. The upper and lower base member pairs are integrally molded of a tough synthetic plastic material, and are each formed with a plurality of symmetrically arranged, cooperative plug pins and through openings for a snap-fit interconnection upon interassembly under clamping pressure. Marginal recesses are formed along the outer or facing sides of the upper and lower base members, within which outer edge portions of the covering material are drawn and secured as by staples to minimize bunching and thereby to provide for close interconnecting assembly of the parts.

6 Claims, 4 Drawing Figures

CUSHIONED TOILET SEAT ASSEMBLY

This invention relates to a cushioned toilet seat assembly and is directed particularly to a novel and improved method and means for the fabrication of the seat and cover members of such assemblies.

In general, cushioned toilet seats are fabricated by applying a comparatively thick layer of the cushioning material, such as foamed rubber or foamed plastic, against the top surface of a relatively thin and hard support base and covering such assembly with a tightly drawn outer skin or layer of sheet vinyl or the like synthetic plastic material. Various methods and devices have heretofore been employed to secure the outer covering in place. Commonly, the vinyl covering material is applied to fully enclose the structure, and heat-sealed along abutting junctures. Another method involves fabricating the base of the cushioned seat or cover of two parts, each of which is marginally overlapped by the outer covering material and there secured in place, after which the two outside covered base members are secured in face-to-face relation to complete the assembly. In my U.S. Pat. No. 4,085,468 issued Apr. 25, 1978 titled CUSHIONED TOILET SEAT ASSEMBLY, I describe such a construction. My present invention is directed particularly to further improvement in this latter method of construction.

It is the principal object of this invention to provide a method and means for assembling cushioned toilet seat and cover members of the type having individually covered upper and lower sections secured together without the use of glue, and wherein such close interfit is achieved as will render the parting line of the inter-assembled upper and lower portions practically invisible.

Another object of the invention is to provide a cushioned toilet seat and associated cushioned cover wherein the respective upper and lower base portions will remain so tightly attached to one another as to eliminate any possibility of their separation except by the use of extraordinary prying force.

A more particular object of my invention is to provide a cushioned toilet seat or cover of the above nature wherein the upper and lower base members are integrally molded of a tough synthetic plastic material, and wherein the interconnection means for final assembly comprises a plurality of symmetrically arranged plug pins and through openings in each of said members adapted to fit in interlocking engagement upon the application of clamping pressure when placed in face-to-face relative position.

Still another object of my invention is to provide interfitting base member pairs of the character described, each pair of which is symmetrical about a longitudinal axis and the members of each pair of which are identical mirror image counterparts of one another to provide for their both being manufactured by the same injection mold die.

Yet another object of my invention resides in the provision, in the mating surfaces of each of the upper and lower base portions, of marginal recesses for the drawing in and attachment of the outer covering material to prevent bunching protrusion at the mating surfaces upon final assembly and thereby to assure close interfitting connection of the assembly seat cover members upon final assembly.

Other objects, features and advantages of the invention will be apparent from the following description when read with reference to the accompanying drawings. In the drawings, wherein like reference numerals denote corresponding parts throughout the several views.

Figure 1:
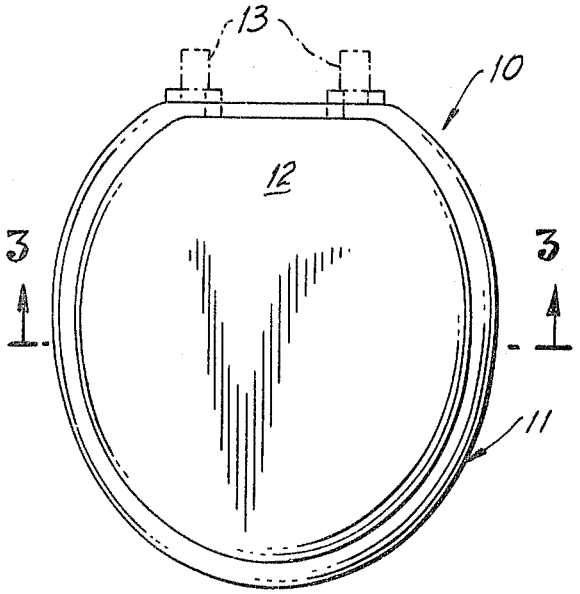
FIG. 1 is a top view of a typical toilet seat assembly embodying the invention.

Referring now in detail to the drawings, reference numeral 10 designates, generally, a padded or cushioned toilet seat assembly embodying the invention, the same comprising seat member 11 and a cover member 12 which, in use, will be hinged together in use by the usual hinges 13, indicated in broken lines in FIG. 1 and which are adapted for connection with the bowl of a toilet in the usual fashion.

Since the inventive features herein described and claimed apply equally to the seat member 11 and seat cover member 12, both being cushioned, fabrication of said seat member only will now be described in detail by way of example.

Figure 2:
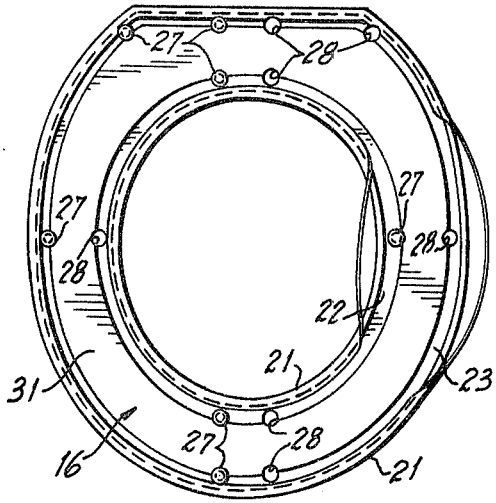
FIG. 2 is an inside view of the cushioned seat member, shown separately and with covering fabric portions separated to reveal constructional details.
Figure 3:
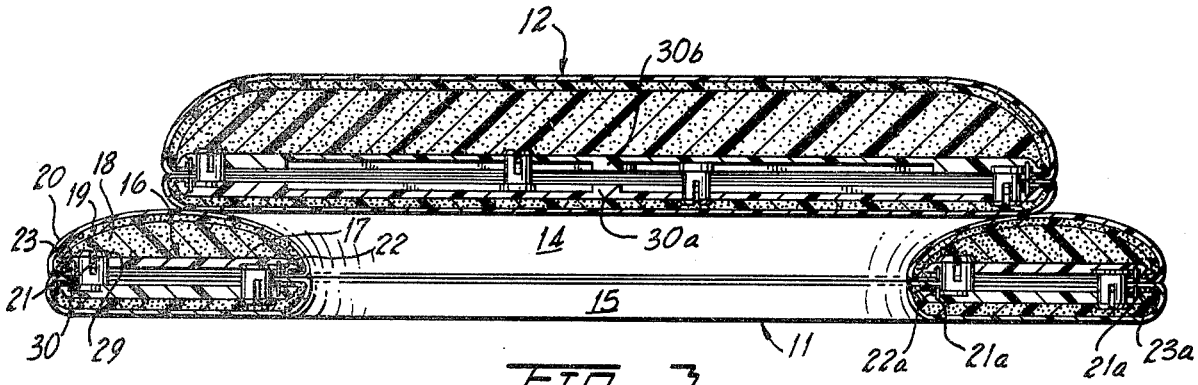
FIG. 3 is a vertical cross-sectional view taken along the line 3—3 of FIG. 1 in the direction of the arrows.
Figure 4:
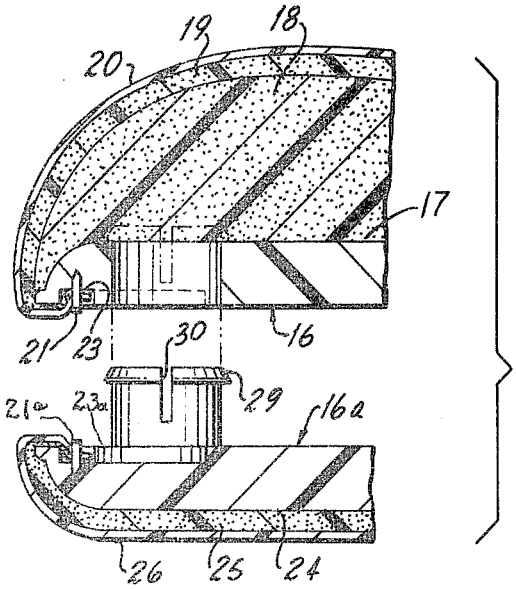
FIG. 4 is a partial view, on an enlarged scale, of separated upper and lower portions of the seat member illustrated prior to their face-to-face snapfit interfitting engagement under pressure.

Referring now to FIGS. 2 and 3, the seat member 11 comprises upper and lower members 14 and 15, respectively, which are individually assembled and then interfittingly clamped together in the manner hereinafter more particularly described. Referring to FIGS. 3 and 4, and considering first the assembly of the upper seat member 14, the seat comprises a substantially flat, integrally molded synthetic plastic member 16 having a general peripheral shape of the finished seat member, i.e., of generally annular configuration. Placed in successive layers upon the flat uppersurface 17 of the integrally molded backing member 16 are a cushioning layer of foamed material 18, a comparatively thin layer of foamed material 19, and a covering or outer layer 20 of surface finish material, such as fabric-backed sheet vinyl material. As best illustrated in FIG. 4, although of the same general peripheral shape, the enveloping layer 19 and cover sheet layer 20 are somewhat greater in width so as to enable their being stretched over and around the cushioning layer 18 and the backing member 16 to be marginally secured in place thereunder by a series of peripherally-extending staples 21. To prevent such bunching of the covering layers as so attached as would prevent close fitting interengagement of the upper and lower seat members 14, 15 when interfittingly assembled in the manner hereinbelow more particularly described, the backing member 16 is formed in the underside, i.e., the outside, with inner and outer marginal, peripherally-extending recesses 22, 23 (only recess 23 illustrated in FIG. 4). Thus, as best illustrated in FIG. 4 (see also FIG. 2) a plurality of the staples 21 serve to secure marginal edge portions of the cover sheet layer within the recesses 22, 23 without such protrusion of the staple heads or bunching of the fabric as would otherwise interfere with close interfitting face-to-face interconnecting engagement of the assembled upper and lower seat members 14 and 15, as is hereinafter described.

The lower member 15 of seat member 11 similarly comprises an integrally molded synthetic plastic backing member 16*a*, identical with upper member 16, against the underside or flat undersurface 24 of which is placed an enveloping layer of foamed plastic 25 covered by a finished layer 26, such as of fabric-backed sheet vinyl material, which will preferably be the same as the covering material 20 of upper seat member 14. As in the assembly of the upper seat member 14 described above, outer marginal portions of the foamed plastic enveloping layer and the outer fabric-backed sheet vinyl material cover layer 25, 26, respectively, are stretched around the undersurface of the backing member 16*a* to be secured about upper marginal portions thereof within recesses 22*a*, 23*a* by the use of staples 21*a*.

A salient feature of my invention resides in the provision of improved means for securely interconnecting the thus assembled upper and lower seat members 14, 15 together without the use of glue or another adhesive. To this end, as best illustrated in FIG. 2, the backing member 16 (16*a*), which is symmetrical about its longitudinal axis, is integrally formed, in the mating surface, with a plurality of outwardly-projecting plug pins 27 and through openings 28. It is to be particularly noted that the projecting plug pins 27 and through openings 28 are, as a group, symmetrically disposed, and are peripherally spaced, about the backing member 16, and that each projecting plug pin 27 has as its counterpart a through opening 28 so that, when a pair of backing members 16, 16*a* are placed in mating, face-to-face disposition for assembly, each of said plug pins in one of the backing members will be in coaxial alignment with its counterpart through opening in the other backing member. As further illustrated in FIGS. 3 and 4, each of the projecting plug pins 27 is of such size as to be snugly received in its associated through opening 28, and is formed as its outer end with a peripheral bead 29 providing for snap-lock interconnection upon press fitting the mating backing members together during final assembly. Upper end portions of the plug pins 27 are diametrically slotted, as at 30, to provide for resilient lateral compression of said upper end portions during passage through their respective through opening. As best illustrated by the broken-line representation thereof in FIG. 4, the plug pins 27 are of such length that the beaded ends thereof will expand behind the flat upper or inner surface 17 of backing member 16 upon tight interfitting engagement of the upper and lower seat members 14, 15. As hereinabove described, the heads of the staples 24 securing the covering fabric in place are well below the surfaces defined by the marginally overlaping portions of the covering fabric, so that very tight face-to-face engagement of said overlaping portions is achieved, resulting in a parting line in the completed assembly that is very inconspicious.

As illustrated in FIG. 2, the plug pins 27 and openings 28 are located near the outer edges of the backing member 16 to provide for enhanced interclamping pressure along outer marginal mating zone portions of the upper and lower seat members 14, 15. As further illustrated in FIG. 2 the mating surface 31 of the backing member 16 may be formed with a central, peripherally-extending, shallow recess if desired, for economy of manufacture in the molding process.

As described above, the cover member 12 is fabricated similarly to that of the seat member 11, the principal difference being that there is no central opening, and marginal attachment of the corresponding parts is effected about the outer peripherary only of the corresponding upper and lower cover member parts. In this connection it will also be understood that the backing members 30*a*, 30*b* of the cover member 12 are also identical, and symmetrical about the longitudinal axis with respect to disposition of the associated plug pins and openings, so that only a single ejection molding die is required for their manufacture.

While I have illustrated and described herein only one form in which my invention can conventiently be embodied in practice it is to be understood that this form is given by way of example only and not in a limiting sense. My invention, in brief, comprises all the embodiments and modifications coming within the scope and spirit of the following claims.

What I claim as new and desire to secure by Letters Patent is:

1. A cushioned toilet seat member, comprising, in combination a pair of substantially flat, integrally-molded upper and lower base members, upholstery material covering the respective top and bottom of said upper and lower base members, a cushioning member interposed between said covering material and their respective upper and lower base members, said upholstery material comprising outer sheet material layers surrounding peripheral edge portions of their respective upper and lower base members and terminating in marginal portions overlapping the respective bottom and top of said upper and lower base members, means securing said marginal overlapping portions to the bottom and top of said upper and lower base members, respectively, each of said upper and lower base members being formed with plurality of through openings and a plurality of plug pins extending outwardly of said bottom of said upper base member and said top of said lower base member, said through openings and said plug pins being so disposed that each of said plug pins in one of said upper and lower base members is in axial alignment with a through opening in the other of said base members when said upper and lower base members are so arranged that the bottom of said upper member is in aligned, face-to-face engagement with the top of said lower base member, said plug pins being of such size as to be received through their respective aligned openings and comprising means for interlocking within their respective opening for securing together said upper and lower base members.

2. A cushioned toilet seat member as defined in claim 1 wherein said plug pin interconnecting means comprises a peripherally enlarged, resilient head portion at the terminal end of each of said plug pins, said head portions being operative to expand beyond the inner ends of their associated through openings for locking said upper and lower base members in said face-to-face engagement.

3. A cushioned toilet seat member as defined in claim 2 wherein said marginal operlapping portions securing means comprises peripherally extending marginal recesses formed in the respective bottom and top of said upper and lower base members, and tacking means for securing said marginal overlapping portions within and with respect to bottom surface portions of said recesses.

4. A cushioned toilet seat member as defined in claim 2 wherein said upper and lower base members are of identical construction.

5. A cushioned toilet seat member as defined in claim 1 wherein said marginal overlapping portions securing means comprises peripherally extending marginal recesses formed in the respective bottom and top of said upper and lower base members, and tacking means for securing said marginal overlapping portions within and with respect to bottom surface portions of said recesses.

6. A cushioned toilet seat member as defined in claim 5 wherein said tacking means comprises a plurality of staples.

* * * * *